US010714823B2

(12) United States Patent
Balanis et al.

(10) Patent No.: US 10,714,823 B2
(45) Date of Patent: Jul. 14, 2020

(54) LOW-PROFILE, WIDEBAND, HIGH GAIN SPIRAL RADIATING ELEMENT ABOVE AN ARTIFICIAL MAGNETIC CONDUCTOR GROUND PLANE

(71) Applicants: Constantine A. Balanis, Mesa, AZ (US); Mikal Askarian Amiri, Tempe, AZ (US); Craig R. Birtcher, Scottsdale, AZ (US)

(72) Inventors: Constantine A. Balanis, Mesa, AZ (US); Mikal Askarian Amiri, Tempe, AZ (US); Craig R. Birtcher, Scottsdale, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 225 days.

(21) Appl. No.: 15/880,827

(22) Filed: Jan. 26, 2018

(65) Prior Publication Data

US 2018/0212318 A1 Jul. 26, 2018

Related U.S. Application Data

(60) Provisional application No. 62/450,879, filed on Jan. 26, 2017.

(51) Int. Cl.
*H01Q 1/48* (2006.01)
*H01Q 7/06* (2006.01)
(Continued)

(52) U.S. Cl.
CPC ..... *H01Q 1/48* (2013.01); *H01Q 1/38* (2013.01); *H01Q 7/06* (2013.01); *H01Q 9/27* (2013.01); *H01Q 15/006* (2013.01)

(58) Field of Classification Search
CPC .. H01Q 1/48; H01Q 1/38; H01Q 7/06; H01Q 9/27; H01Q 15/006
See application file for complete search history.

(56) References Cited

U.S. PATENT DOCUMENTS 5,045,819 A 9/1991 Balanis et al.
8,860,575 B2 10/2014 Allee et al.
(Continued)

FOREIGN PATENT DOCUMENTS

WO 2011022099 A2 2/2011
WO 2011022101 A2 2/2011

OTHER PUBLICATIONS

/www.antenna-theory.com/antennas/travelling/spiral.php, "Spiral Antennas", Antenna-Theory.com, 2009-2015, entire document (Year: 2015).*
(Continued)

*Primary Examiner* — Dameon E Levi
*Assistant Examiner* — David E Lotter
(74) *Attorney, Agent, or Firm* — Fish & Richardson P.C.

(57) ABSTRACT

Antenna structure with a curvilinear radiating element and a circularly symmetric high impedance surface ground plane. The curvilinear radiating element has a first diameter in a plane of the curvilinear radiating element and the circularly symmetric high impedance surface ground plane has a second diameter in a plane of the circularly symmetric high impedance surface ground plane. The curvilinear radiating element is positioned proximate the circularly symmetric high impedance surface ground plane with the plane of the curvilinear radiating element parallel to the plane of the circularly symmetric high impedance surface ground plane. A surface of the curvilinear radiating element is separated from a surface of the circularly symmetric high impedance surface ground plane by a distance.

20 Claims, 9 Drawing Sheets

(51) Int. Cl.

| | |
|---|---|
| ***H01Q 1/38*** | (2006.01) |
| ***H01Q 15/00*** | (2006.01) |
| ***H01Q 9/27*** | (2006.01) |

(56) References Cited

U.S. PATENT DOCUMENTS

| | | | | |
|---|---|---|---|---|
| 2004/0027308 | A1* | 2/2004 | Lynch | H01Q 9/27 343/895 |
| 2009/0174623 | A1* | 7/2009 | Schreider | H01Q 1/243 343/895 |
| 2012/0007791 | A1* | 1/2012 | Grbic | H01Q 9/27 343/895 |
| 2012/0062433 | A1 | 3/2012 | Balanis et al. | |
| 2013/0249762 | A1* | 9/2013 | Grelier | H01Q 9/27 343/834 |
| 2013/0278481 | A1* | 10/2013 | Voltmer | H01O 15/0006 343/904 |
| 2018/0212331 | A1 | 7/2018 | Balanis et al. | |

OTHER PUBLICATIONS

Amiri et al. "Analysis, Design and Measurement of Circularly Symmetric High Impedance Surfaces for Loop Antenna Applications". IEEE Antennas and Wireless Propagation Letters, vol. 64, Issue 2, Dec. 7, 2015, pp. 1080-1083.

Amiri et al. "Applications of Circularly Symmetric High Impedance Surfaces for Spiral Antennas", IEEE International Symposium on Antennas and Propagation (APSURSI), pp. 1913-1914. doi: 10.1109/APS.2016.7696663. Jun. 26-Jul. 1, 2016.

Amiri et al. "Design, Simulation and Antenna Applications of Spherical High Impediance Surfaces". 2016 IEEE International Symposium on Antennas and Propagation (APSURSI), pp. 1911-1912. doi: 10.1109/APS.2016.7696662. Jun. 26-Jul. 1, 2016.

Amiri et al. "Gain and Bandwith Enhancement of Spiral Antenna Using Circularly Symmetric HIS". IEEE Antennas and Wireless Propagation Letters, vol. 16, Oct. 27, 2016, pp. 1080-1083.

Dendini et al, "Hybrid dielectric resonator antenna with circular mushroom-like structure for gain improvement," IEEE Transactions on Antennas and Propagation, vol. 57, No. 4, pp. 1043-1049, 2009.

Durgun et al, "Design, simulation, fabrication and test of flexible bow-tie antennas," IEEE Transactions on Antennas and Propagation, vol. 59, No. 12 , pp. 4425-4435, 2011.

Durgun et al, "Reflection phase characterization of curved high impedance surfaces," IEEE Transactions on Antennas and Propagation, vol. 61, No. 12 , pp. 6030-6038, 2013.

Ettore et al, "Sector PCS-EG antenna for low-cost high-directivity applications," IEEE Antennas and Wireless Propagation Letters, vol. 6, pp. 537-539, 2007.

Llombart et al, "Planar circularly symmetric EBG structures for reducing surface waves in printed antennas," IEEE Transactions on Antennas and Propagation, vol. 53, No. 10. , pp. 3210-3218, 2005.

Neto et al, "On the optimal radiation bandwidth of printed slot antennas surrounded by EBGs," IEEE Transactions on Antennas and Propagation, vol. 54, No. 4 , pp. 1074-1083, 2006.

SalarRahimi et al, "Radiation properties enhancement of a GSM/WLAN microstrip antenna using a dual band circularly symmetric EBG substrate," IEEE Transactions on Antennas and Propagation, vol. 60, No. 11, pp. 5491-5494, 2012.

Sarrazin et al, "Circular High-Impedance Surfaces Characterization," IEEE Letters on Antennas and Wireless Propagation, vol. 11, pp. 260-263, 2012.

Simovski et al, "High-impedance sur-faces having stable resonance with respect to polarization and incidence angle," IEEE Transactions on Antennas and Propagation, vol. 53, No. 3, pp. 908-914, 2005.

"Werner "An exact integration procedure for vector potentials of thin circular loop antennas," IEEE Transactions on Antennas andPropagation, vol. 44, No. 2, pp. 157-165, 1996."

Yang et al. "Reflection phase characterizations of the EBG ground plane for low profile wire antenna applications," IEEE Transactions on Antennas and Propagation, vol. 51, No. 10, pp. 2691-2703, 2003.

* cited by examiner

LOW-PROFILE, WIDEBAND, HIGH GAIN SPIRAL RADIATING ELEMENT ABOVE AN ARTIFICIAL MAGNETIC CONDUCTOR GROUND PLANE

CROSS-REFERENCE TO RELATED APPLICATION

This application claims the benefit of U.S. Provisional Patent Application 62/450,879 entitled "LOW-PROFILE, WIDEBAND, HIGH GAIN SPIRAL RADIATING ELEMENT ABOVE AN ARTIFICIAL MAGNETIC CONDUCTOR GROUND PLANE" filed on Jan. 26, 2017, which is incorporated by reference herein in its entirety.

TECHNICAL FIELD

This invention relates to low-profile, wideband, high gain antenna structures.

BACKGROUND

High impedance surfaces (HIS) have emerged as a breakthrough in modern antenna design technology. These surfaces have an in-phase reflection coefficient at a certain frequency band which resembles the behavior of a magnetic conductor.

SUMMARY

Low-profile, high gain and wideband antenna structures are described. The structures include curvilinear radiating elements positioned above high impedance surfaces.

In a general aspect, an antenna structure includes a curvilinear radiating element and a circularly symmetric high impedance surface ground plane. The curvilinear radiating element has a first diameter in a plane of the curvilinear radiating element and the circularly symmetric high impedance surface ground plane has a second diameter in a plane of the circularly symmetric high impedance surface ground plane. The curvilinear radiating element is positioned proximate the circularly symmetric high impedance surface ground plane with the plane of the curvilinear radiating element parallel to the plane of the circularly symmetric high impedance surface ground plane. A surface of the curvilinear radiating element is separated from a surface of the circularly symmetric high impedance surface ground plane by a distance.

In some implementations, the curvilinear is in the form of a spiral element. In some cases, the spiral element is a two-arm spiral element. In some examples, the number of turns in each arm can be two. The first diameter of the spiral element can be in a range between 1 cm and 3 cm. An expansion rate of the spiral element can be in a range between 0.1 cm and 1 cm. Thickness of the spiral element may be 0.02 mm.

In some cases, the spiral element is formed of a conductor having a width in a range between 1 mm and 2 mm. For example, the spiral element can include copper. The copper can be adhered to a dielectric film. In some examples, the spiral element is adhered to a thin dielectric film of 0.05 mm thickness.

In some implementations, the distance between the spiral element and the surface of the high impedance surface ground plane is 0.05 mm.

In some implementations, the circularly symmetric high impedance surface ground plane comprises two to six concentric circular rings. In some cases, each ring has periodic gaps in an angular direction. In some examples, angular periodicity of each of the rings is 20 degrees. Each periodic gap can be in a range of 1 degree to 10 degrees. The radial gap of each of the rings may be in a range between 0.5 mm and 2 mm. In some cases, each of the rings resonates at substantially the same frequency. In some implementations, the circularly symmetric high impedance surface ground plane has an angular periodicity.

In some implementations, the curvilinear radiating element is in the form of a loop.

In some implementations, the curvilinear radiating element and the circularly symmetric high impedance surface ground plane are positioned such that a line from a center of the curvilinear radiating element to a center of the circularly symmetric high impedance surface ground plane is perpendicular to the plane of the curvilinear radiating element and the plane of the circularly symmetric high impedance surface ground plane. In some implementations, the circularly symmetric high impedance surface ground plane is spherical.

The details of one or more implementations of the subject matter described in this specification are set forth in the accompanying drawings and the description below. Other features, aspects, and advantages of the subject matter will become apparent from the description, the drawings, and the claims.

DETAILED DESCRIPTION

The present disclosure provides antenna structures with low-profile, high gain, wideband radiating elements on top of HISs as ground plane. The radiating elements have a curvilinear shape, such as a spiral or a loop.

In some implementations, the HIS is applied on a dielectric (e.g., Rogers RT/duroid 5880) substrate. In one example, the thickness of the substrate is 0.635 centimeter (cm). In some cases, the HIS has a top surface and a bottom surface. For example, the bottom surface can cover all or part of the dielectric substrate. The bottom surface can include one or more metals, such as copper. In some examples, the top surface includes patches of metal material (e.g., copper sheets) that cover the dielectric substrate.

The antenna structures in the present disclosure include HIS designs that possess wide operational bandwidth when used as ground planes for curvilinear wideband radiating elements. A circular HIS as a ground plane for a curvilinear radiating element can provide an enhanced gain compared to a rectangular HIS or a perfect magnetic conductor (PMC) ground plane. A PMC material can be an idealized material exhibiting infinite permeability.

Figure 1A:
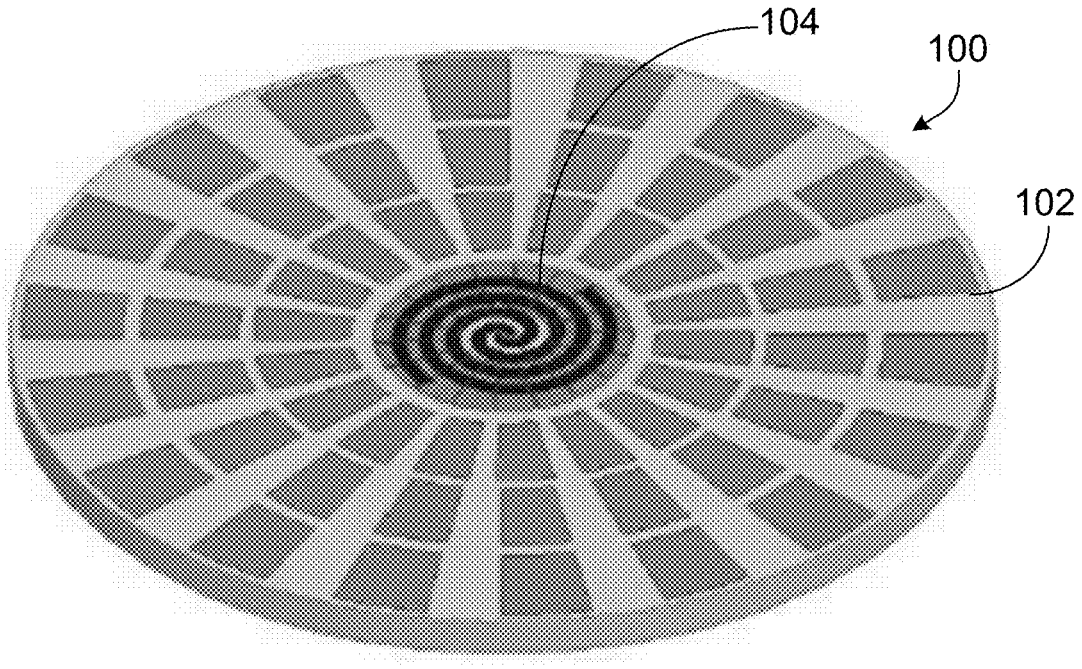
FIGS. 1A-1B depict top views of antenna structures.
Figure 1B:
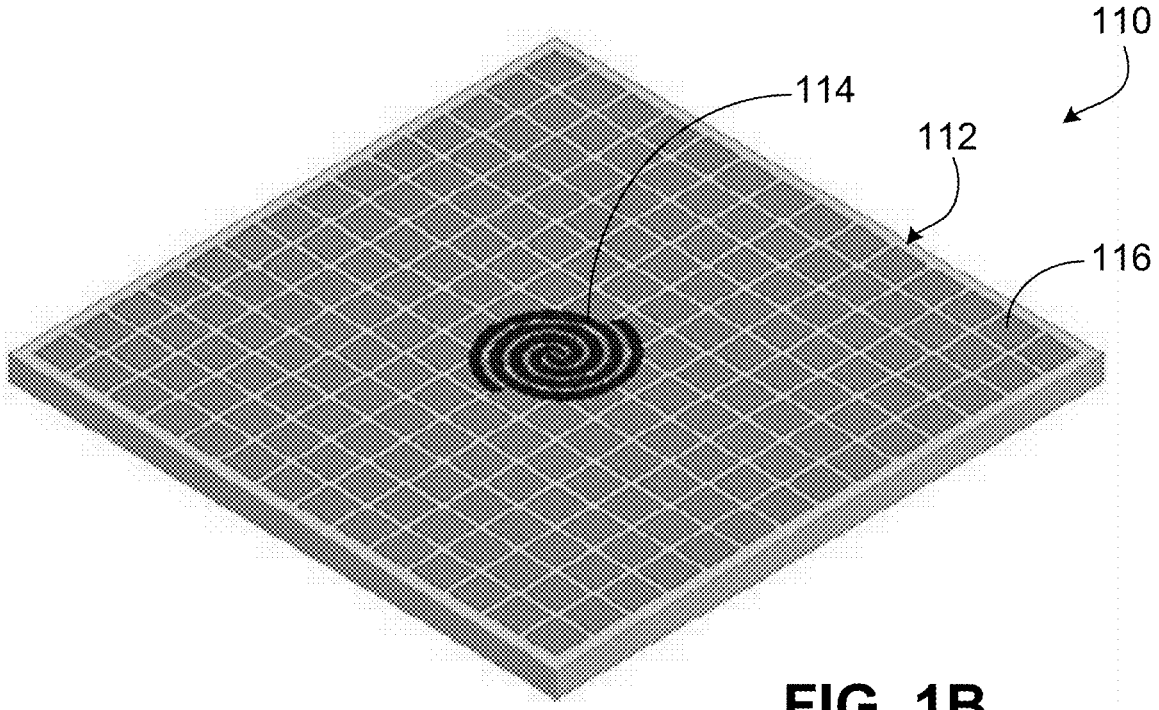

FIG. 1A depicts a top view of an antenna structure 100, according to an implementation. The antenna structure 100 includes a HIS 102 and a radiating element 104. The HIS 102 is circular and is a ground plane for the radiating element 104. FIG. 1B depicts a top view of an antenna structure 110 with a rectangular HIS 112 as a ground pane for a radiating element 114. The rectangular HIS 112 has patches 116. In some cases, the patches are identical. In some cases, one or more of the patches 116 are square.

Figure 2A:
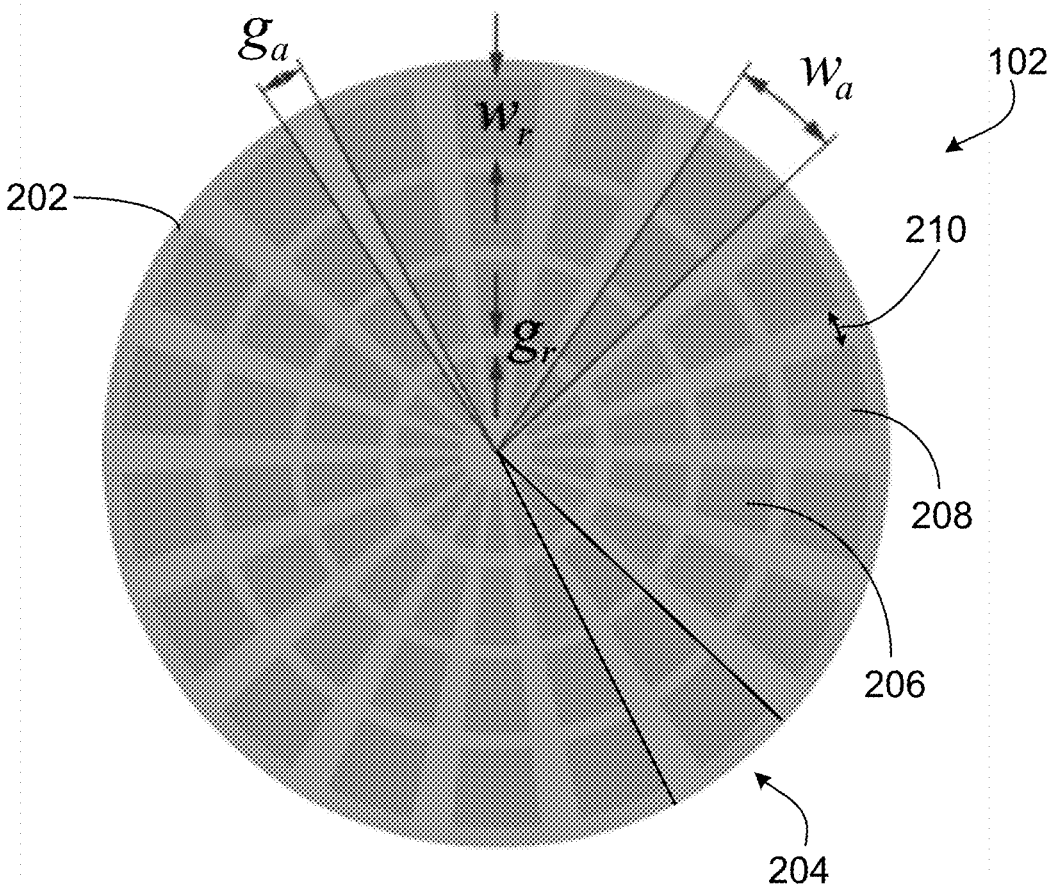
FIGS. 2A-2B depict high impedance surfaces.

A HIS can be circular, polygonal, or a combination of both shapes. FIG. 2A illustrates a top view (or top surface) of the HIS 102. The HIS 102 has a dielectric 202 (e.g., a RT/duroid 5880) substrate. The top surface of the dielectric 202 can be covered by unit cells 204. A unit cell can include curved patches (e.g., 206, 208). A unit cell can be separated from its neighboring unit cells with gaps 210 in the angular direction. The angular design parameters for the case of HIS 102 are patch angle $w_\alpha$, gap angle $g_\alpha$, radial patch length $w_r$, and radial gap length $g_r$. A unit cell 210 can have unit cell angle $\alpha_\alpha$and a radial length $\alpha_r$ of:

$$\alpha_\alpha=\omega_\alpha+g_\alpha \quad (1), \text{ and}$$

$$\alpha_r=\omega_r+g_r \quad (2).$$

In one example, HIS 102 (referred to as "HIS-1") has these parameters: the unit cell angle ($\alpha_a$) is 20°, the gap angle ($g_\alpha$) is 6 degrees, the unit cell radial length ($\alpha_r$) is 2.22 cm, and the radial gap length ($g_r$) is 0.9 cm. HIS 102 can also be divided into four rings of patches. For example, HIS-1 can have four rings: $1^{st}$ ring, $2^{nd}$ ring, $3^{rd}$ ring, and $4^{th}$ ring; with the $1^{st}$ ring being the closest ring to the center of the circular HIS-1 and the $4^{th}$ ring being the farthest ring. The table below lists angular gap and radial gap for outer side of the four rings in the example HIS-1 design.

| Parameter | Angular Gap (degree) | Radial Gap (mm) |
|---|---|---|
| $1^{st}$ ring | 1 | 1.35 |
| $2^{nd}$ ring | 6.6 | 1.1 |
| $3^{rd}$ ring | 8.4 | 1.1 |
| $4^{th}$ ring | 9.5 | 1.2 |

A HIS can be designed to have reflection phase of zero at one or more particular frequencies. In some cases with circular rings, such as the ones in FIG. 2A, the rings can be designed to all resonate at the same frequency. For example, the HIS-1 has a zero reflection phase at 4.5 GHz.

Figure 2B:
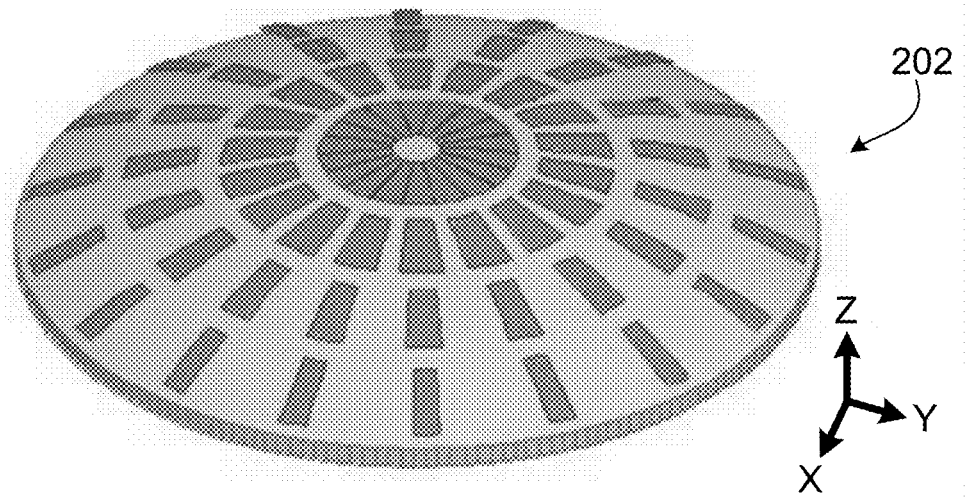

In some implementations, HIS is planar (e.g., HIS 102). In some implementations, HIS has a curvature or is considered as a part of a sphere (i.e., spherical). FIG. 2B depicts a spherical HIS 220 in a convex form. The HIS 220 has four rings.

As illustrated in FIG. 2A, the arc length of unit cells of HIS-1 increases for outer rings. In some cases, the arc length is kept much smaller than the wavelength ($\alpha_\alpha \ll \lambda$) at the highest frequency (e.g., 3 GHz or 3.5 GHz in free space) of the operational bandwidth of the antenna structure. As discussed in this disclosure, in some implementations, the operational bandwidth is considered to be the frequency interval over which return loss of the overall structure (e.g., antenna structure 100) was below −10 dB. In some examples, λ, is the highest frequency at which the return loss is below −10 dB.

In one example, HIS 220 (referred to as "HIS-2") has these parameters: xy-projection of the HIS-2 has unit cell angle $\alpha_\alpha$of 20 degrees and a radial length $\alpha_r$ of 2 centimeters (cm). The table below lists angular gap $g_\alpha$, and radial gap $g_r$ for outer side of the four rings in HIS-2. The HIS-2 can be designed to have zero reflection phase at 4.5 GHz. Considering HIS-2 as a sphere cap, the radius of curvature of the spherical cap is 25 cm.

| Parameter | $g_\alpha$ (degree) | $g_r$ (cm) |
|---|---|---|
| 1st ring | 0.5 | 0.5 |
| 2nd ring | 7 | 0.5 |
| 3rd ring | 13 | 0.5 |
| 4th ring | 15 | 0.6 |

Figure 3:
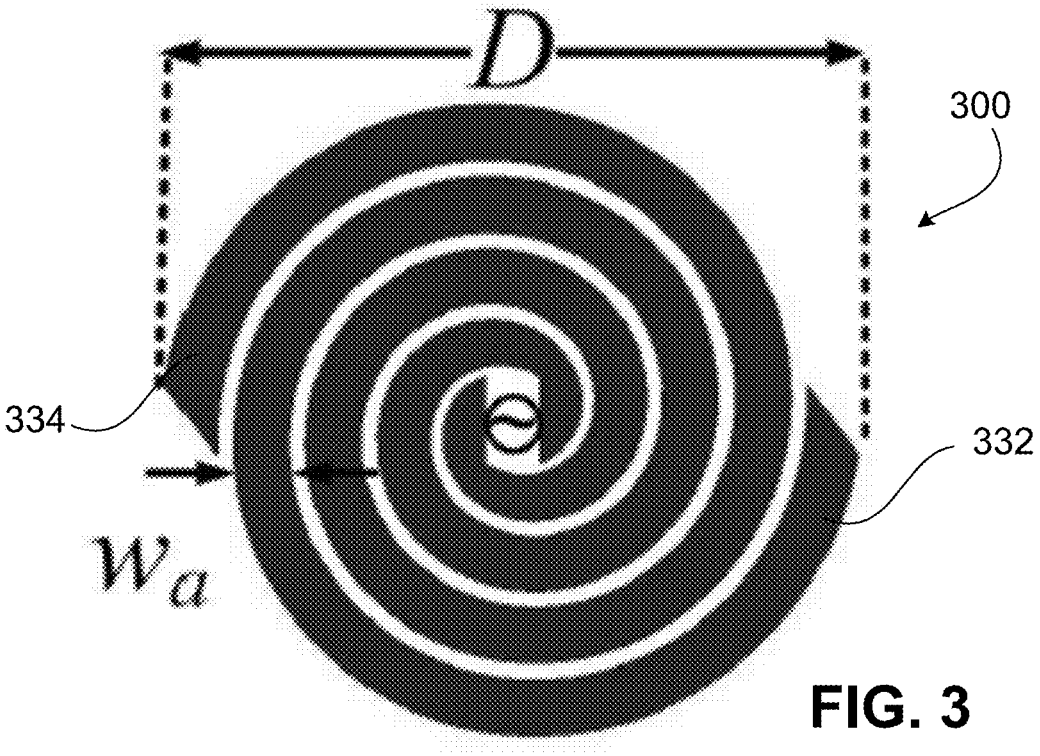
FIG. 3 depicts a radiating element.

Going back to FIG. 1, the radiating element 104 can have a curvilinear shape, such as a loop or a spiral. FIG. 3 depicts a radiating element 300, according to an implementation. The radiating element 300 is a spiral and has two arms 322 and 324. Each of the two arms 322 and 324 has two turns. The spiral (i.e., radiating element 300) has an expansion rate (a rate at which the spherical antenna grows) α and a diameter D. Each arm of the spiral can be made of (or partly made of) a conductor. In some cases, the arms have equal lengths. In one example, each arm has a width $w_{s\alpha}$of 1.27 mm.

In some implementations, the radiating element (e.g., 104) is positioned in a close proximity of the ground plane HIS (e.g., 102). In some cases, the distance d between the radiating element and the HIS depends on the radiating frequency at which the antenna structure is being used. In some cases, the distance d is much less than the wavelength of the radiating frequency. In one example, the distance d is 0.005 of wavelength of the radiating frequency. For example, for radiating frequency of 3.5 GHz, the distance d is 0.005×66.6 mm.

EXAMPLES

Antenna structures, each with a curvilinear radiating element and a HIS ground plane, were simulated and fabricated. Reflection phase, return loss and operational bandwidth, gain pattern, and broadside gain were measured.

Figure 4:
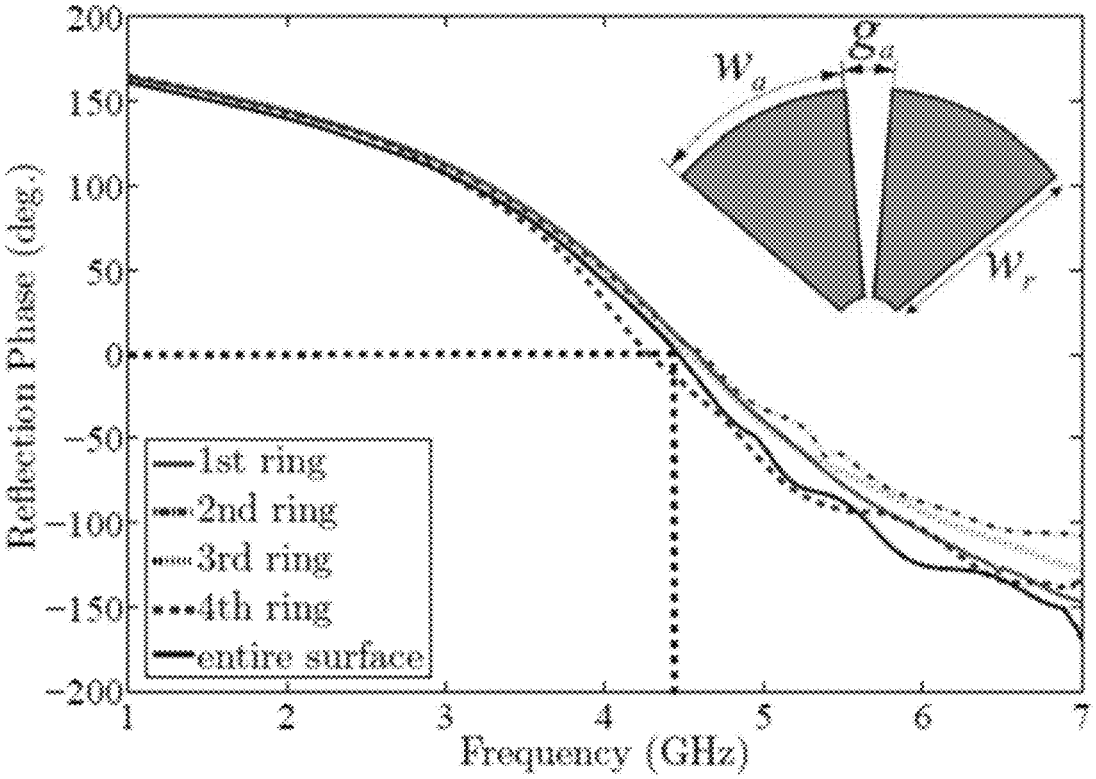
FIG. 4 is a plot showing reflection phase for a circular antenna structure.

To obtain the reflection phase of the circular HIS 102 under a z-directional transverse electromagnetic (TEMz) cylindrical wave illumination, a magnetic line source was simulated. Perfect magnetic conductor boundary conditions (i.e., infinite permeability as the boundary condition) were assigned to the surface of the inner and outer conductors of a coaxial cable to have electric field vector in φ-direction (azimuthal direction). FIG. 4 illustrates the reflection phase diagram of the circular HIS-1 with a resonant frequency of 4.5 GHz.

To obtain the operational bandwidth of an antenna structure with a HIS used as the structure's ground plane, the radiating element was placed at a small height above top surface of the HIS. For example, the radiating element 104 (e.g., spiral 300) of FIG. 1 was placed in a close proximity of the circular HIS 102. The diameter of the radiating element (e.g., 300) was then varied and the frequency interval over which return loss of the overall structure (e.g., antenna structure 100) was below −10 dB was considered to be the operational bandwidth of the respective antenna structure.

In a first experiment, an antenna structure of FIG. 1A with HIS-1 ground plane and a spiral radiating element (as radiating element 104) was used. The spiral radiating element (referred to as "spiral element") had two arms. In each measuring case of this experiment, the number of turns of each arm was maintained at two and the rate of expansion changed. The expansion rate a of the spiral element was changed from 0.25 cm to 0.5 cm to increase diameter D of the spiral element from 1.5 cm to 2.2 cm. The spiral element was located at a height of 0.005λ above the circular HIS, and λ was the wavelength at 3.5 GHz. A lumped port with input impedance of 50 ohms was used. The lumped port was located at the center of the HIS to excite the spiral element. Ansys HFSS software was used to simulate the antenna structures.

Figure 5:
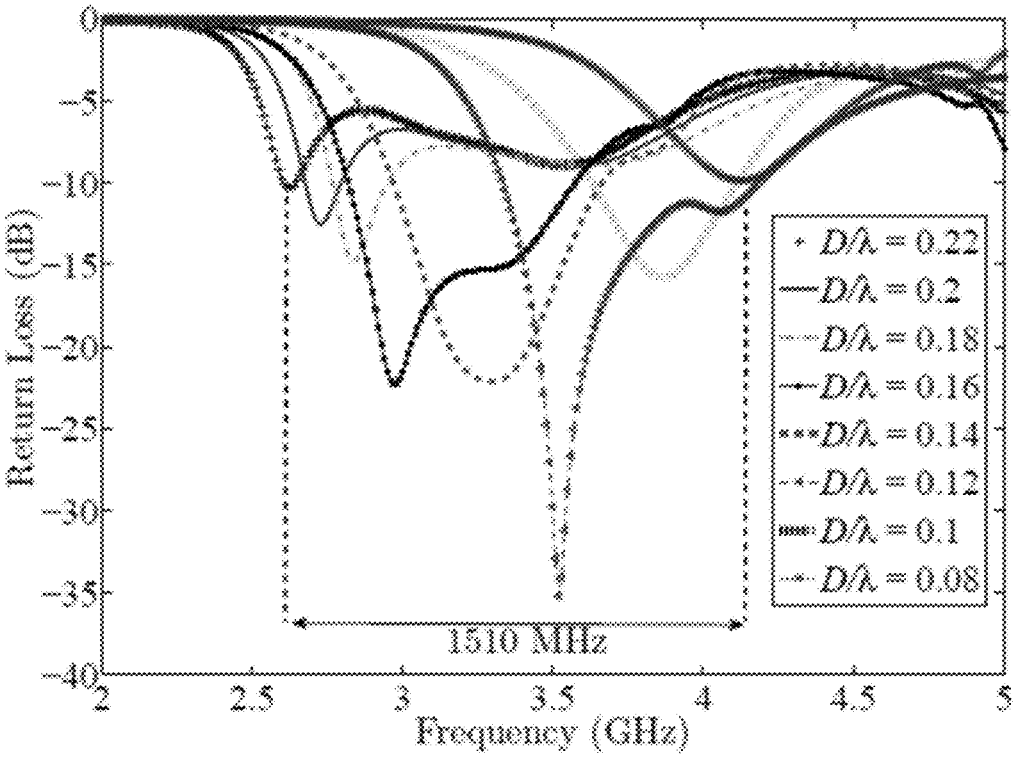
FIG. 5 is a plot showing return loss of circular antenna structures.

FIG. 5 is a plot showing return loss of a circular antenna structure with the parameters described in the previous paragraph (i.e., the first experiment). As illustrated, the −10 dB operational bandwidth of the antenna structure with the spiral element at 0.005λ above the circular HIS-1 was 44% at 3.5 GHz.

In a second experiment, operational bandwidth of an antenna structure with the circular HIS-1 was compared with operational bandwidth of an antenna structure with a rectilinear HIS. An antenna structure of FIG. 1B with a rectangular HIS with sides of 14 cm and surface area of 210 $cm^2$ was designed. The rectangular HIS had square patches (e.g., 116) of 0.8 cm width. The patches were separated from each other by 1 cm (e.g., the center to center distance between two patches was 1 cm). The rectangular HIS of the second experiment and the circular HIS-1 of the first experiment had equal surface area. Plane wave was used for the structure with the rectangular HIS and Transverse electromagnetic wave (TEM) was used for the structure with the circular surface. The spiral elements of the first experiment were located at 0.005λ (at 3.5 GHz) above the rectangular HIS (see FIG. 1B) and expansion rate a of the spiral element was changed from 0.25 cm to 0.5 cm to increase diameter D of the spiral element from 1.5 cm to 2.2 cm.

Figure 6:
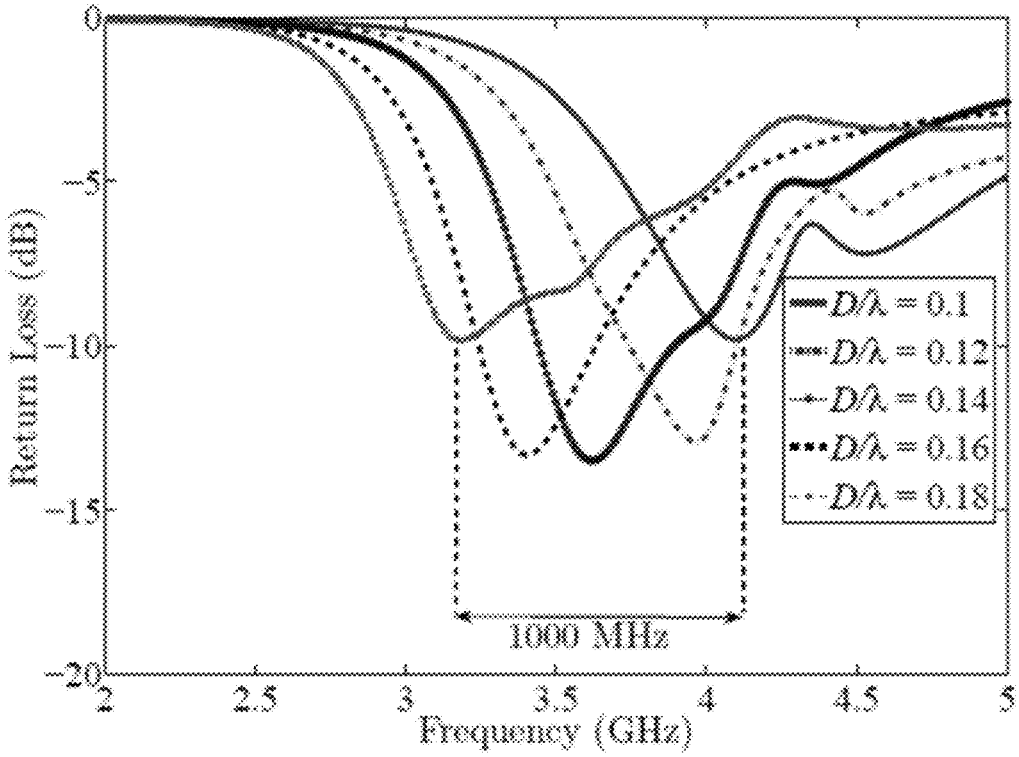
FIG. 6 is a plot showing return loss of rectangular antenna structures.

FIG. 6 is a plot showing return loss of rectangular antenna structures with the parameters described in the previous paragraph (i.e., the second experiment). As illustrated, the −10 dB operational bandwidth was 28% at 3.5 GHz. Comparing FIGS. 5 and 6 show that the operational bandwidth of the antenna structure with the circular HIS-1 of the first experiment was about 16% greater than operational bandwidth of the antenna structure with the rectangular HIS of the second experiment.

It was also simulated and confirmed that regardless of the distance of the radiating elements from the HIS ground plane or the size of the HIS, a spiral element provides a wider operational bandwidth above a circular HIS compared to a rectangular HIS with an identical surface area. For instance, in one experiment, the operational bandwidth of an antenna structure with the spiral element and a circular HIS with only three rings was 39%, while the operational bandwidth of an antenna structure with the same spiral element and a rectangular HIS (with the same surface area as the circular HIS) was 25%.

Figure 7:
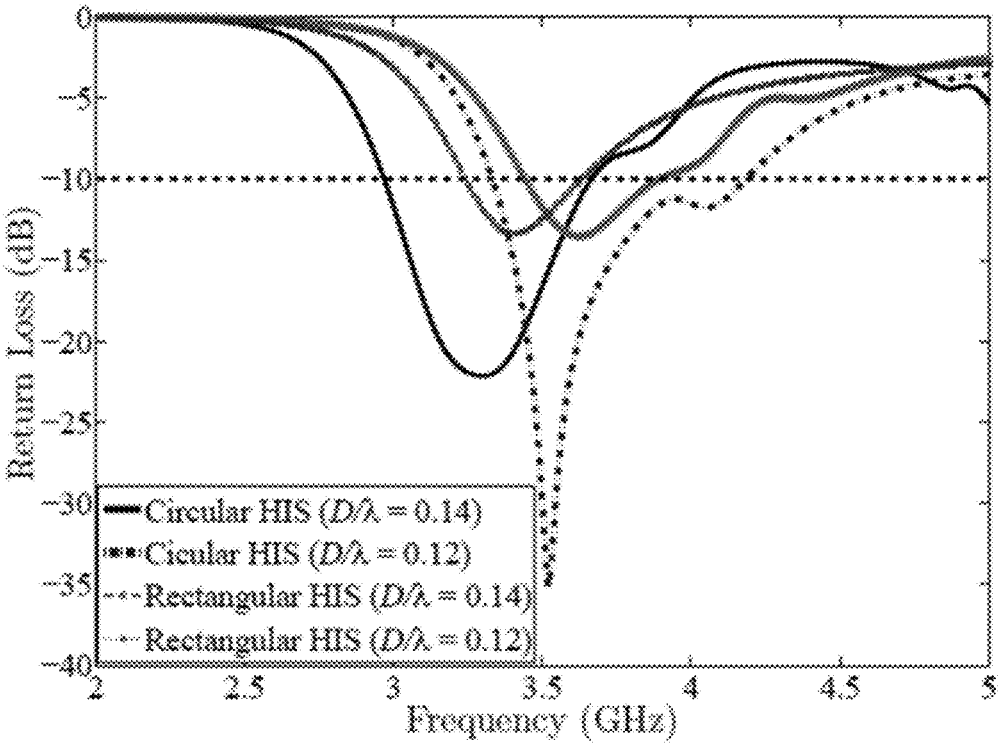
FIG. 7 is a plot showing fractional bandwidth of circular and rectangular antenna structures.

FIG. 7 is a plot showing fractional bandwidth antenna structures with spiral radiating elements. FIG. 7 includes fractional bandwidth for circular and rectangular HISs with the same surface area, and for two spiral elements (D/λ=0.12 and 0.14). As illustrated, the −10 dB fractional bandwidth of the spiral element above circular HIS was wider than above rectangular HIS. For example, at 3.5 GHz the fractional bandwidth of the spiral element D/λ=0.14 was 24% when positioned above the circular HIS and was 13.7% when positioned above the rectangular HIS. Other curvilinear radiating elements provide results similar to a spiral radiating element.

Figure 8:
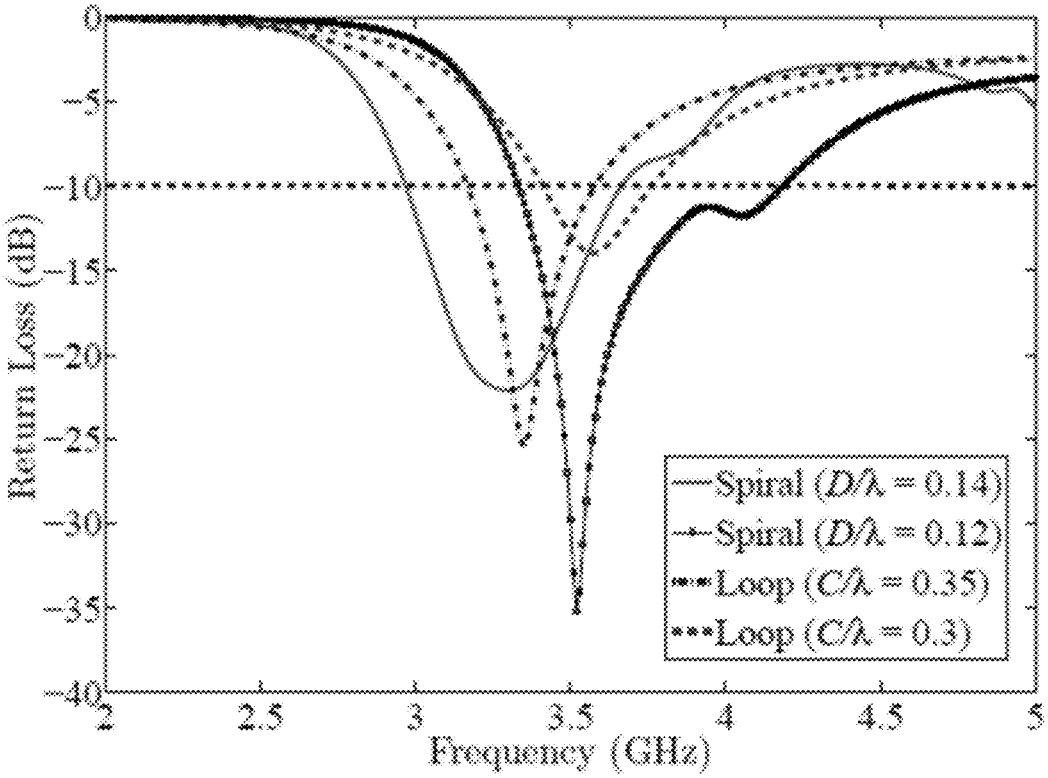
FIG. 8 is a plot showing return loss of antenna structures with spiral and loop radiating elements.

FIG. 8 provides the return losses of spiral and loop radiating elements when each was positioned at the same height above a circular HIS. The loop element used for FIG. 8 had a ring shape, with circumference C. At 3.5 GHz, the fractional bandwidth of the spiral element (D/λ=0.12) was 18% which was 7% wider than that of the loop element (C/λ=0.3).

Figure 9:
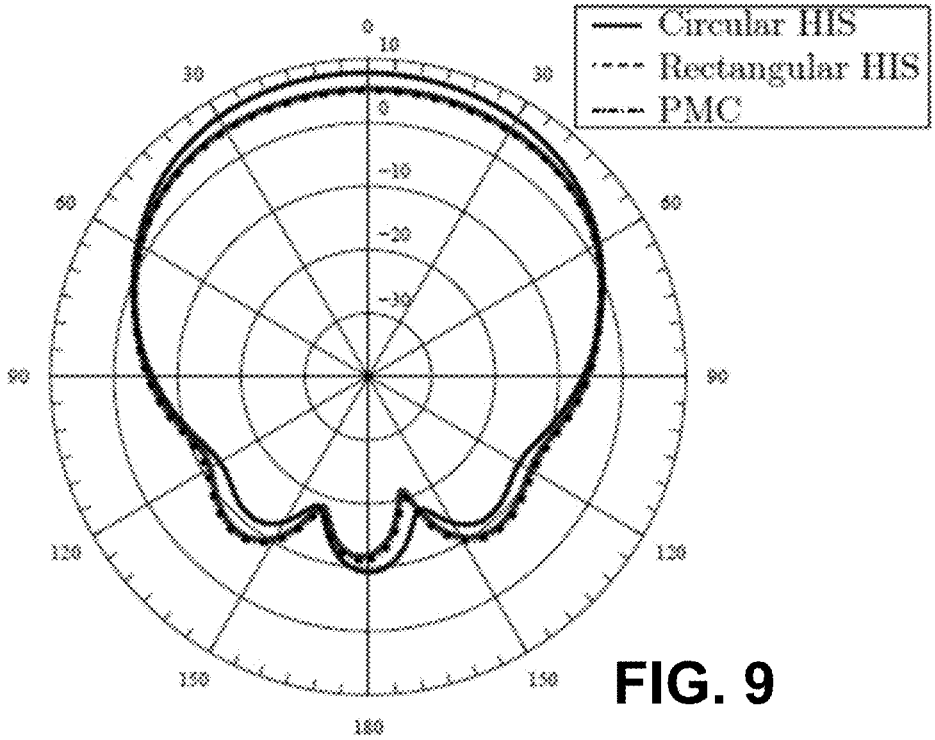
FIG. 9 is a plot showing gain pattern of antenna structures at 3.5 GHz.

FIG. 9 is a plot showing gain pattern of antenna structures with spiral elements at 3.5 GHz. The spiral element had the same parameters as in the first experiment. The spiral element was located at height of 0.005λ above a circular HIS, a rectangular HIS and a PMC ground plane. According to image theory, the gain of any radiator above a PMC ground plane should be 3 dB greater than that of the radiator in free space. The broadside gain of the spiral element was about 2.5 dB in free space. As illustrated in FIG. 9, the gain was 5.5 dB, 5.5 dB, and 8 dB when the spiral element was located on top of a PMC, a rectangular HIS, and a circular HIS ground plane, respectively.

Figure 10:
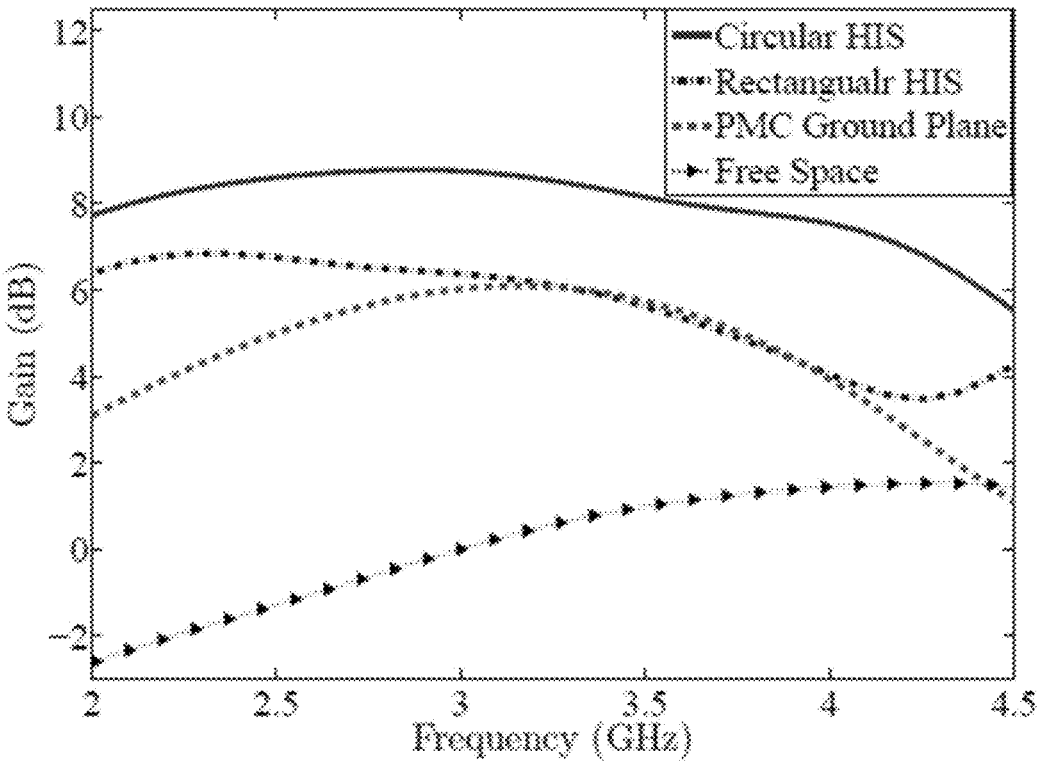
FIG. 10 is a plot showing broadside gain of antenna structures.

FIG. 10 shows the broadside gains of the antenna structures used in FIG. 9 over a range of frequencies. The greater gain in the circular HIS compared to the rectangular HIS can be attributed to the phases of the reflected fields created from the spiral element. For example, although all of the four rings of the circular HIS 102 were adjusted to have the same reflection characteristic under normal illumination, they did not have the same reflection characteristic when a localized source was positioned at the center and at a small height above the ground plane. Thus, each ring illuminated at a different incidence angle. Since the texture of the surface and the incidence angle varied in the radial direction, the fields reflected from different parts of the surface possessed variable phases. The variable phases of the reflected fields lead to a constructive interference. This constructive interference ultimately provided a strong field intensity in the broadside direction (which is perpendicular to the plane of the curvilinear element). Thus, curvilinear radiating elements, such as loop and spiral elements, can benefit from the constructive radial phase profile of circular HIS. This constructive phase profile lead to an additional 2.5 dB gain increase in FIG. 9 and a greater broadside gain in FIG. 10 of the circular HIS compared to the rectangular HIS and the PMC ground plane.

In a third experiment, the antenna structure of FIG. 1A was fabricated. A two-arm spiral element with two turns and an expansion rate of 0.45 cm was etched on copper tape and adhered to a thin dielectric film of 0.05 mm thickness. A coaxial cable feed-line and a wideband balun were attached underneath the ground plane, to reduce impact of the coaxial cable on the radiation pattern of the antenna structure. The wideband balun can be designed, for example, by tapering the outer conductor of a coaxial cable. The balun was passed through a clearance hole made at the center of circular HIS of the antenna structure. The tapered and inner conductors were then connected to each arm of the spiral.

Figure 11A:
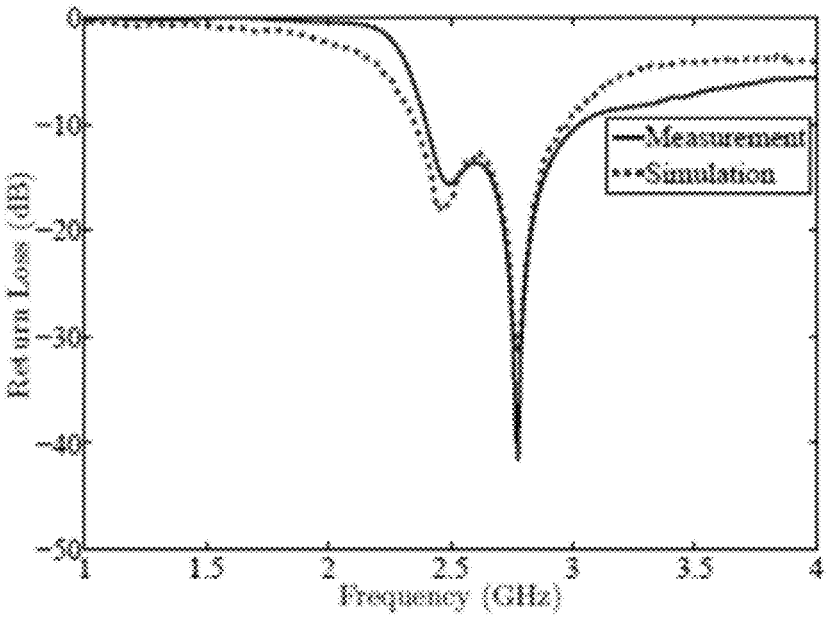
FIG. 11A is a plot showing return loss of an antenna structure.
Figure 11B:
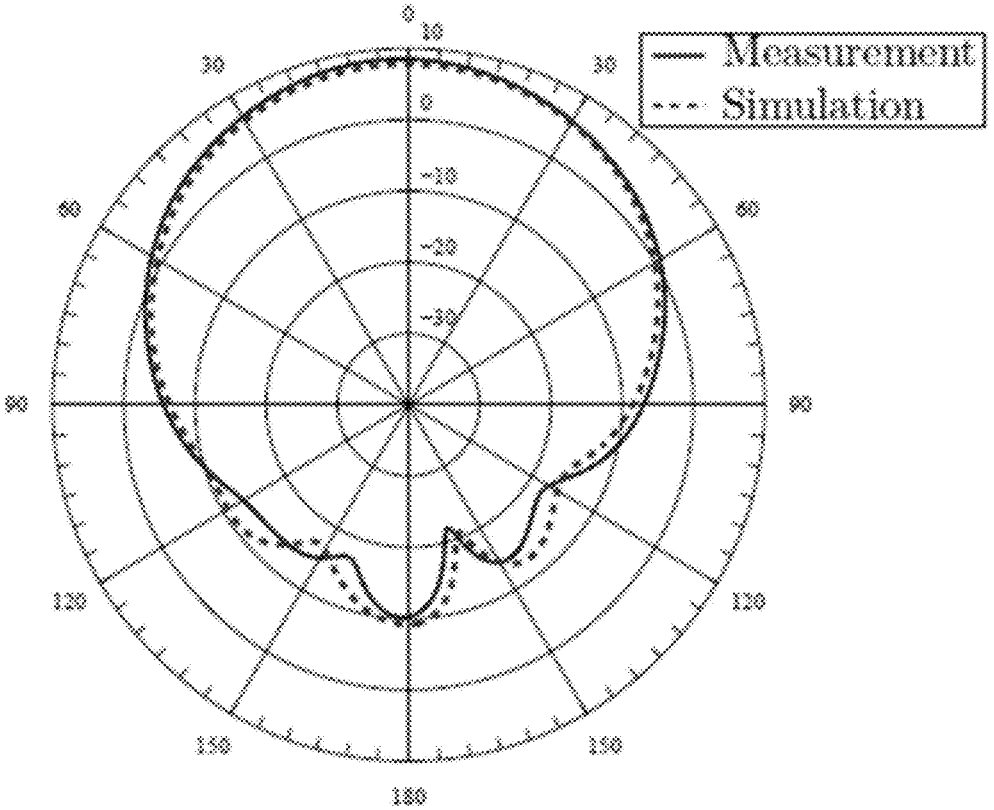
FIG. 11B is a plot showing realized gain pattern of an antenna structure.

FIGS. 11A-B are plots showing the simulated and measured return loss and realized gain patterns of the fabricated antenna structure of the third experiment at the resonant frequency of 2.7 GHz. As illustrated, the maximum realized gain was 8 dB. The differences between the measured and simulated realized patterns on the back angular regions can be due to fabrication process of the balun.

Figure 12:
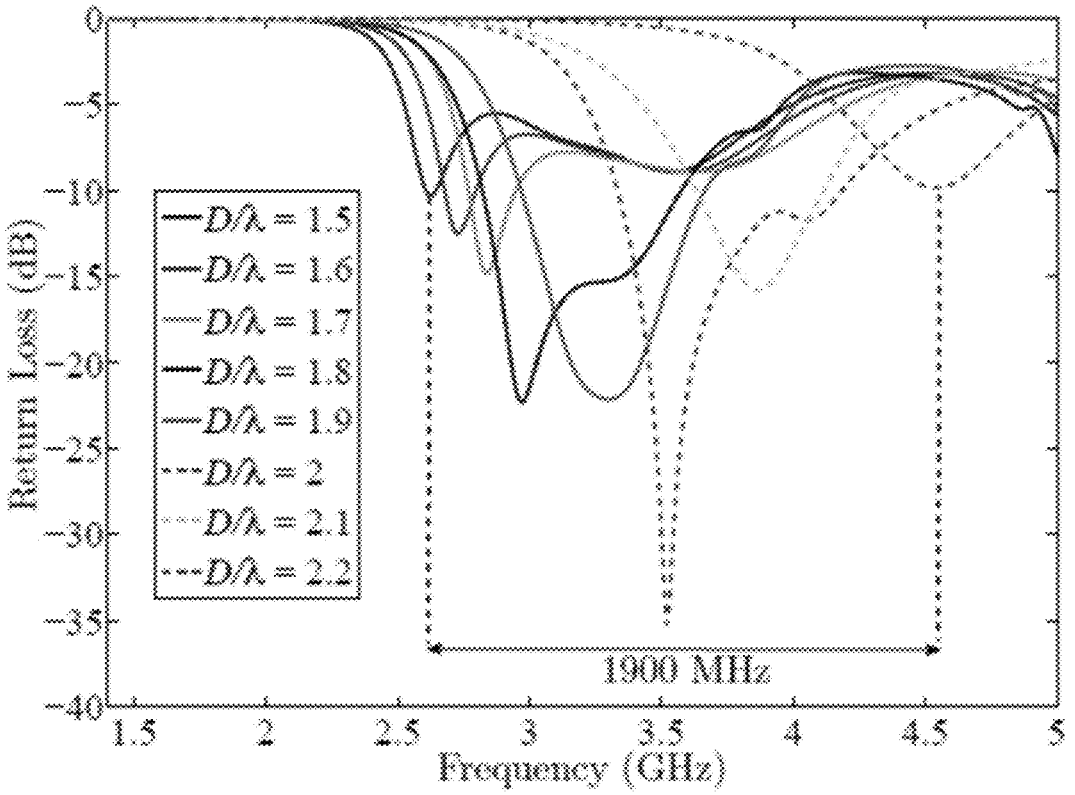
FIG. 12 is a plot showing return loss of circular antenna structures.

A fourth experiment was a repeat of the first experiment, but the radiating element (the spiral element) in the fourth experiment was located at 0.01λ above HIS-1, and λ was the wavelength at 3 GHz. A person skilled in the art would recognize that 3 GHz was chosen for experimental purposes and other structures can be designed for other frequencies. FIG. 12 is a plot showing return loss of the circular antenna structure. As illustrated, the −10 dB operational bandwidth of the antenna structure with the spiral element at 0.01λ above HIS-1 was about 63% at 3 GHz.

Figure 13:
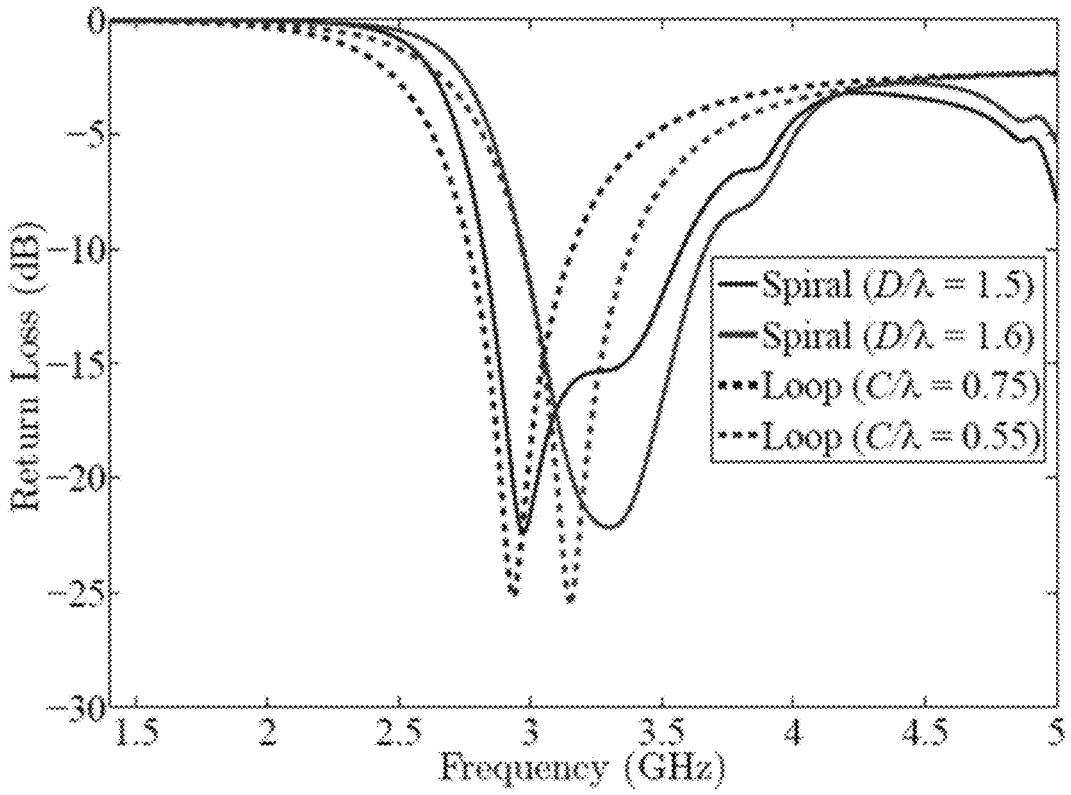
FIG. 13 is a plot showing return loss of antenna structures with spiral and loop radiating elements.

The fourth experiment was repeated for loop radiating elements instead of the spiral element. FIG. 13 is a plot showing return losses of spiral and loop radiating elements when located at the same height (i.e., 0.01λ at 3 GHz) above a circular HIS-1. In FIGS. 13, D and C are diameters of the spiral and the loop radiating elements, respectively. As illustrated, the −10 dB fractional bandwidth of the spiral was wider than that of the loop. For instance, at 3 GHz, the fractional bandwidth of the loop antenna with C/λ=0.75 was 12.6% while the spiral antenna with D/λ=1.5 had a fractional bandwidth of 25.3%.

In a fifth experiment, an antenna structure with a loop radiating element and a spherical HIS was designed and simulated. The previously explained spherical (or curved) HIS-2 was used in the fifth experiment as the ground plane and a loop antenna was positioned at a height of 0.01λ cm above the spherical HIS at 3 GHz. The loop radiating element had a radius of 1 cm and had a single round of conductor (a ring shape). Similar to the first experiment, the radius of the loop radiating element was then varied and the frequency interval, within which the return loss of the antenna structure was below −10 Db, was measured as the operational bandwidth of the antenna structure.

Figure 14:
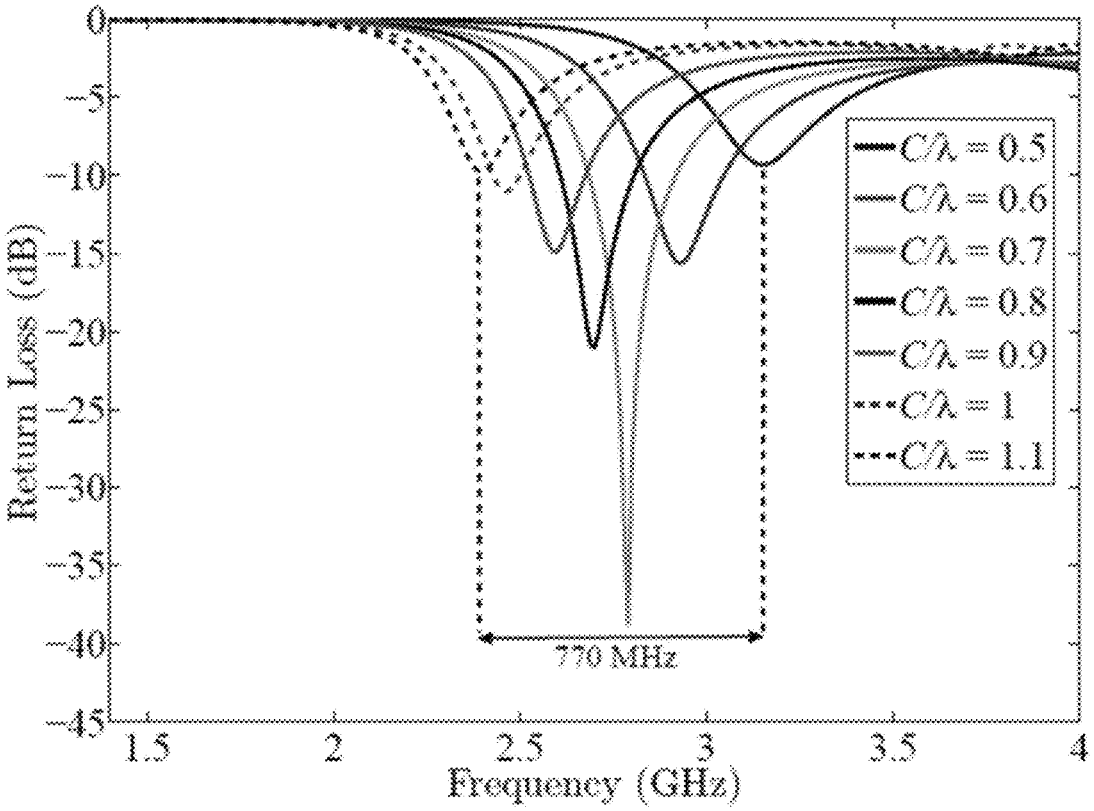
FIG. 14 is a plot showing return loss of spherical antenna structures.

FIG. 14 exhibits return losses of the antenna structures of the fifth experiment. As illustrated, the −10 dB operational bandwidth was 25.6% at 3 GHz. The operational bandwidth of an antenna structure with a flat HIS (not shown) with parameters of projection of HIS-2 in xy-plane and with the same loop radiating element was 37%.

Figure 15:
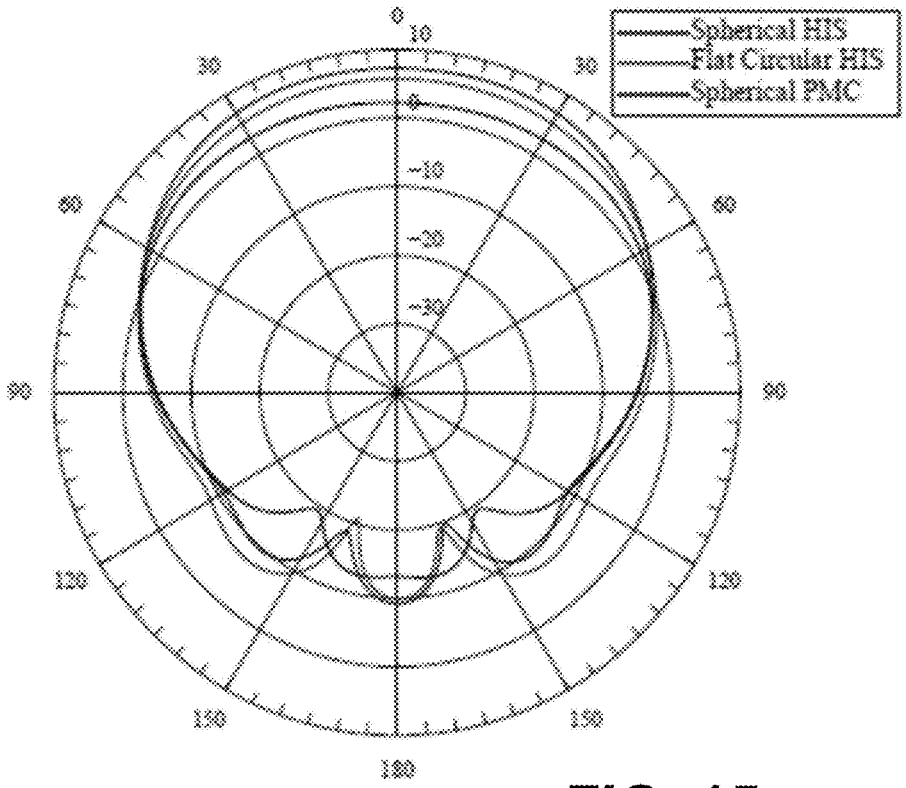
FIG. 15 is a plot showing gain patterns of antenna structures with loop radiating elements.

FIG. 15 is a plot showing gain pattern of three antenna structures with loop radiating elements at 3 GHz. Ground planes of antenna structures used for FIG. 15 were the spherical structure of the fifth experiment, a flat structure that was the projection of the spherical structure in xy-plane, and a spherical PMC structure with the same dimensions as the curved structure. The same loop radiating element was used in all three structures and was located at the same height above the ground plane of all three structures. As illustrated, the broadside gain of the spherical antenna structure was lower than the broadside gain of the flat antenna structure. Such decrease in the gain can be in part due to the curvature of the ground plane, which scatters more energy in non-broadside directions compared to a flat ground plane.

Also as illustrated in FIG. 15, the spherical antenna structure had a 3 dB higher gain than the spherical PMS. The additional 3 dB in the gain can be attributed to the phase of the waves reflected from the spherical HIS. Similar to the HIS-1, each ring reflected the waves at a different angle and the reflection phase profile of the spherical HIS changed from the center towards the edge of the HIS. Thus, the reflected waves from different parts of the surface caused constructive interference that contributed in providing a string field intensity in the broadside direction. Hence, the reduction in the gain caused by curvature of the HIS-2 ground plane was partly compensated by the non-constant reflection coefficient distribution in the spherical structure.

A number of embodiments have been described. Nevertheless, it will be understood that various modifications may be made without departing from the spirit and scope of disclosure. Accordingly, other embodiments are within the scope of the following claims.

What is claimed is:

1. An antenna structure comprising:

a curvilinear radiating element having a first diameter in a plane of the curvilinear radiating element; and a circularly symmetric high impedance surface ground plane having a second diameter in a plane of the circularly symmetric high impedance surface ground plane, wherein the circularly symmetric high impedance surface ground plane is spherical, and wherein the curvilinear radiating element is positioned proximate the circularly symmetric high impedance surface ground plane with the plane of the curvilinear radiating element parallel to the plane of the circularly symmetric high impedance surface ground plane, and a surface of the curvilinear radiating element is separated from a surface of the circularly symmetric high impedance surface ground plane by a distance.

2. The antenna structure of claim 1, wherein the curvilinear radiating element is in the form of a spiral element.

3. The antenna structure of claim 2, wherein the spiral element is a two-arm spiral element.

4. The antenna structure of claim 3, wherein a number of turns in each arm is two.

5. The antenna structure of claim 2, wherein the first diameter of the spiral element is in a range between 1 cm and 3 cm.

6. The antenna structure of claim 2, wherein an expansion rate of the spiral element is in a range between 0.1 cm and 1 cm.

7. The antenna structure of claim 2, wherein the spiral element is formed of a conductor having a width in a range between 1 mm and 2 mm.

8. The antenna structure of claim 2, wherein the spiral element comprises copper.

9. The antenna structure of claim 8, wherein the copper is adhered to a dielectric film.

10. The antenna structure of claim 2, wherein a thickness of the spiral element is 0.02 mm.

11. The antenna structure of claim 2, wherein the spiral element is adhered to a thin dielectric film of 0.05 mm thickness.

12. The antenna structure of claim 2, wherein a distance between the spiral element and the surface of the high impedance surface ground plane is 0.05 mm.

13. The antenna structure of claim 1, wherein the circularly symmetric high impedance surface ground plane comprises two to six concentric circular rings.

14. The antenna structure of claim 13, wherein each ring has periodic gaps in an angular direction.

15. The antenna structure of claim 14, wherein each periodic gap is in a range of 1 degree to 10 degrees.

16. The antenna structure of claim 13, wherein an angular periodicity of each of the rings is 20 degrees.

17. The antenna structure of claim 13, wherein a radial gap of each of the rings is in a range between 0.5 mm and 2 mm.

18. The antenna structure of claim 13, wherein each of the rings resonates at substantially the same frequency.

19. The antenna structure of claim 1, wherein the circularly symmetric high impedance surface ground plane has an angular periodicity.

20. The antenna structure of claim 1, wherein the curvilinear radiating element and the circularly symmetric high impedance surface ground plane are positioned such that a line from a center of the curvilinear radiating element to a center of the circularly symmetric high impedance surface ground plane is perpendicular to the plane of the curvilinear radiating element and the plane of the circularly symmetric high impedance surface ground plane.

* * * * *